United States Patent [19]

Klein

[11] Patent Number: 4,601,516

[45] Date of Patent: Jul. 22, 1986

[54] CONTOURED CHAIR

[76] Inventor: Gerhart P. Klein, 45 Raymond St., Manchester, Mass. 01944

[21] Appl. No.: 590,443

[22] Filed: Mar. 16, 1984

[51] Int. Cl.[4] ..... A47C 1/12

[52] U.S. Cl. ..... 297/441; 297/440; 297/457

[58] Field of Search ..... 297/440, 441, 443, 444, 297/457, 450, 454, 452; 29/451, 452, 448, 449

[56] References Cited

U.S. PATENT DOCUMENTS

| | | | |
|---|---|---|---|
| 1,400,717 | 12/1921 | Benson et al. | 297/457 |
| 1,422,915 | 7/1922 | Benson et al. | 297/457 |
| 1,561,065 | 11/1925 | Eggleston | 29/451 |
| 3,570,418 | 3/1971 | Gooding | 297/440 |
| 3,890,660 | 6/1975 | Pedler | 297/441 |
| 4,062,589 | 12/1977 | Klein et al. | 297/441 |

FOREIGN PATENT DOCUMENTS

| | | | |
|---|---|---|---|
| 520799 | 7/1953 | Belgium | 297/444 |
| 667935 | 3/1952 | United Kingdom | 29/451 |

*Primary Examiner*—William E. Lyddane
*Assistant Examiner*—Mark W. Binder
*Attorney, Agent, or Firm*—Cesari and McKenna

[57] ABSTRACT

An article of furniture for sitting includes a closed frame covered by a flexible cover. The opposite sides of the frame are captured in retainers formed in counterfacing surfaces of upright support members held in spaced relation by spacer members. The opposite sides of the frame are resiliently flexible so that they can be stressed from a natural spacing to a lesser spacing without exceeding the elastic limits of the frame sides. When the frame sides are retained by the support members and those members are connected to the spacer members, the frame sides, usually constrained by a nonextensible band or by the fabric cover, possess appreciable stored energy tending to urge them apart toward their natural spacing so that the frame sides are retained securely by the support members under the weight of an ordinary person.

10 Claims, 3 Drawing Figures

CONTOURED CHAIR

This invention relates to furniture. It relates more particularly to an improved chair of the type having a contoured fabric seat supported above the floor by a base.

BACKGROUND OF THE INVENTION

Relatively recently, a line of seating-type furniture such as chairs, ottomans, loveseats and sofas has been developed which is characterized by clean, simple lines, user comfort, strength and durability and relatively low cost. Basically, each such article of furniture includes upright side members which support a fabric seat which is contoured to match the human anatomy. The seat fabric is stretched as a cover across a tubular frame whose opposite sides fit in grooves formed in counterfacing surfaces of the upright side members so that the grooves capture the seat when the side members are properly spaced by spacer members. Examples of such furniture are disclosed in my patent U.S. Pat. No. 4,062,589, as well as in my copending application Ser. No. 570,955, filed Jan. 16, 1984, entitled Design for SEAT.

The flexible fabric seat is thus suspended between the side members providing a comfortable seating area that has no obstructing supporting members to prevent the fabric seat from assuming the contour of the person sitting in the chair or other article of furniture.

As described in the aforesaid patent, in chairs and other similar furniture articles constructed in this fashion, there is a tendency for the seat to pull out of the supporting grooves in the side members due to the weight of a person sitting in the chair. More particularly, the downward force on the seat cover causes the cover to pull the sides of the seat frame inward toward one another so that in some cases those sides are actually pulled out of their supporting grooves. To alleviate this problem, the seat or frame cover is shaped in such a way that the cover obtains its support from the upper and lower ends of the frame. In other words, as disclosed in the above patent, an added amount of slack is provided to the frame cover in the area where the sitter's weight is normally concentrated and where the frame is supported by the side members. That extra slack tends to minimize the lateral forces exerted by the cover on the sides of the frame due to the sitter's weight and to transfer those forces to the opposite ends of the frame which are not supported by the side members. While that solution does solve the problem of seat pull-out, the slack present in the seat cover causes the seat to sag somewhat, thus spoiling to some extent the appearance of the chair.

SUMMARY OF THE INVENTION

Accordingly, it is an object of the present invention to provide seating-type furniture having improved contoured fabric seats.

Another object of the invention is to provide a chair or other article of furniture for seating which includes a contoured fabric seat that is both comfortable to sit on and attractive in appearance.

A further object of the invention is to provide such furniture whose fabric seats do not pull out of their support members yet whose seats, when unoccupied, are taut.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, an article of furniture constructed in accordance with this invention includes a contoured seat similar to the ones described in the aforementioned patent and pending application. The seat is composed of a closed frame preferably formed of metal tubing. The frame is more or less rectangular in the sense that it has spaced generally parallel side portions and end portions connecting the two side portions. The frame may also be bent so that, in profile, it defines a geometric surface which is more or less contoured to match the human body in a sitting or reclining posture.

The present frame differs from the one disclosed in the above patent, however, in that its side portions are bent or bowed laterally away from each other beyond their elastic limits so that those side members are not truly parallel. In other words, in the making of the tubular frame, the side portions thereof are formed with permanent outward bows or arches. Then, prior to covering the frame, the two side portions of the frame are drawn together within their elastic limits by an inextensible loop or band extending between the two frame side portions. The length of the band is such that the frame side portions are maintained more or less parallel to one another as they are in the article of furniture depicted in the aforesaid patent. Now, however, unlike that prior seat frame, the frame side portions are pretensioned with their spacing being fixed by the band which extends between them. In other words, but for that band, the frame side portions would tend to assume their natural, unstressed, further spaced-apart, outwardly bowed positions.

A fabric cover or sheath is then engaged over the pretensioned frame so that the frame is disposed at the periphery of the seat cover. The cover is shaped and dimensioned so that it stretches tautly between the end portions and the pretensioned side portions of the frame. The cover is composed of fabric pieces which are cut more or less rectangularly rather than being specially shaped to provide extra slack as required in the prior patented chair.

The fabric seat is then mounted to the base of the furniture article. The base is preferably similar to the ones disclosed in the aforementioned patent and pending patent application. That is, it includes a pair of spaced-apart, parallel, upstanding support members. The counterfacing surfaces of the support members are grooved or slotted to receive one or more segments of the opposite sides of the covered seat. The base further includes a pair of front and rear spacer members which are connected between the support members to form a stable box-like frame which supports the contoured seat from below. The spacer members are located relative to the seat such that they are spaced from the seat surface so that they do not obstruct or interfere with the stretch or contour assumed by the fabric cover when a person sits down on the seat.

Even though the seat cover is formed to fit the pretensioned frame relatively snugly so that there is no slack or sag in the seat when it is unoccupied, the outward biases of the pretensioned frame side portions offset the lateral forces exerted on those portions by the seat cover due to a person reposing in the seat. Therefore, those frame side portions remain securely engaged in their supporting grooves in the base.

Thus, the present furniture construction solves the potential problem of seat pullout encountered with contoured fabric seats of this general type without creating unsightly slack in the seat cover. Yet, the cost of the furniture is not increased materially, since the solution only involves imparting outward bows or bends to the pre-existing tubular seat frame and pretensioning the side portions of that frame using an inexpensive flexible loop or band, the cost of which is offset by the savings resulting from the ability to use a seat cover made without extra slack. Therefore, furniture made in accordance with this invention should find wide acceptance in the marketplace.

BRIEF DESCRIPTION OF THE DRAWING

For a fuller understanding of the nature and objects of the invention, reference should be had to the following detailed description, taken in connection with the accompanying drawing, in which.

DESCRIPTION OF THE PREFERRED EMBODIMENT

Figure 1:
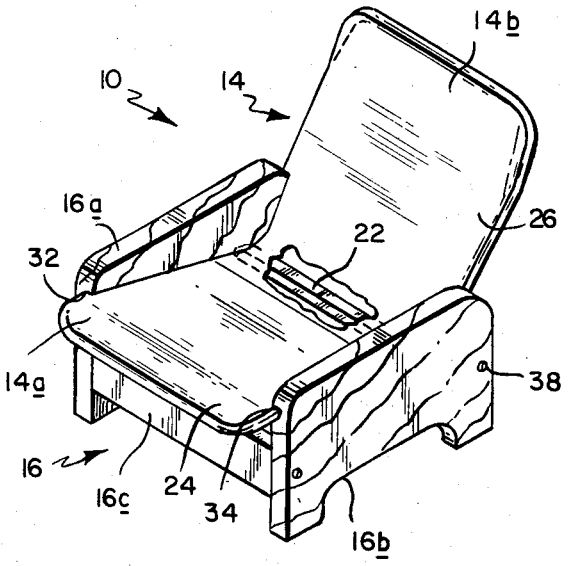
FIG. 1 is a perspective view of an article of furniture, namely, a chair, made in accordance with this invention.

Referring to FIG. 1 of the drawing, an article of furniture made in accordance with this invention is indicated generally at 10. The article specifically illustrated is a chair. However, it should be understood that the invention is equally applicable to other articles of furniture designed for sitting, such as loveseats, sofas, ottomans, etc.

Chair 10 includes a contoured seat shown generally at 14 which is supported at opposite sides by a base 16. In the illustrated chair 10, seat 14 has a more or less horizontal seat portion 14*a* and an upwardly rearwardly inclining back portion 14*b* so that one sits in chair 10 in a relaxed semireclining posture.

Figure 2:
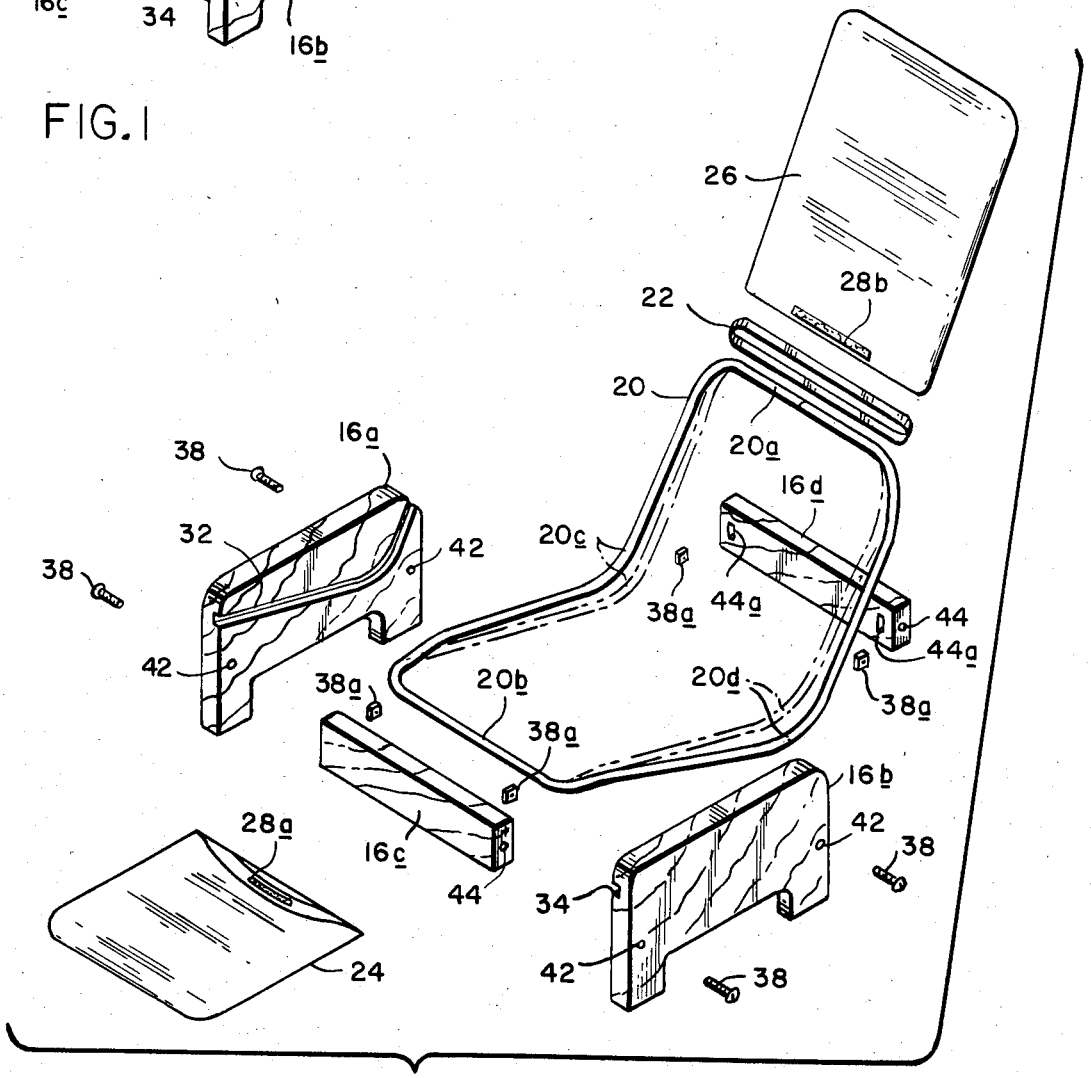
FIG. 2 is an exploded perspective view showing the components of the FIG. 1 chair in greater detail.

Turning now to FIG. 2, contoured seat 14 includes a peripheral frame 20 formed by bending metal tubing such as three-quarter inch steel conduit. The frame has upper and lower end portions 20*a* and 20*b*, as well as spaced-apart side portions 20*c* and 20*d*. It can be made of a single length of tubing bent to the desired shape and whose opposite ends are welded together. Alternatively, the frame 20 may be composed of two connected-together U-shaped sections as described in the aforesaid patent. In either event, frame 20 constitutes a closed loop which is bent so that, in edge profile, it has a contour which matches more or less the human anatomy in a sitting or reclining position.

Figure 3:
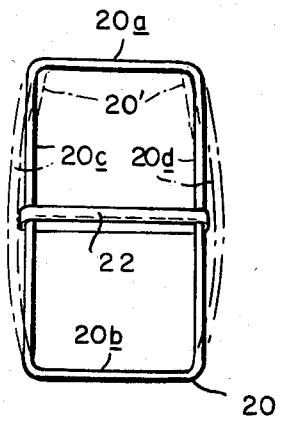
FIG. 3 is a diagrammatic view further illustrating the construction of the FIG. 1 chair.

Referring now to FIGS. 2 and 3, while the upper and lower frame end portions 20*a* and 20*b* are more or less parallel to one another, when the frame is formed, the frame side portions 20*c* and 20*d* are provided with permanent laterally outward bows or bends as shown in solid lines in FIG. 2 and in dot-dash lines in FIG. 3. That is the normal or natural spacing of those frame side portions. However, the chair 10 is not assembled with frame 20 in that condition. Rather, prior to such assembly, the frame side portions 20*c* and 20*d* are drawn or flexed toward one another until they have a lesser spacing wherein they are more or less parallel as shown in dot-dash lines in FIG. 2 and solid lines in FIG. 3. It should be understood that this lesser spacing is greater than the distance between the frame side portions when they are stressed beyond their elastic limits. The frame side portions are maintained in that tensioned or stressed condition by appropriate means such as a flexible band or loop 22 engaged around the frame adjacent the lower end of the seat back portion 14*b*.

The loop 22 can be formed from any nonextensible material such as nylon or polyester strapping. The strapping can be formed into a loop after the strapping has been wound about the frame side portions by joining the ends of the strapping with a crimp seal, heat seal, stitches or the like. Alternatively, the loop can be formed to the proper length prior to being installed on frame 20 and then slid onto the frame from one end. To facilitate such installation, one end of the frame, e.g. the upper end, can be toed in or tapered slightly as indicated in dotted lines at 20' in FIG. 3. In either event, the length of the loop 22 is such that, when engaged at the proper location on frame 20 as shown in FIGS. 1 and 3, the frame side portions 20*c* and 20*d* are maintained in their tensioned or stressed positions more or less parallel to one another. Resultantly, due to their natural resilience, those side portions possess appreciable stored energy and exert considerable forces against the opposite ends of loop 22, with the loop opposing the return of those frame portions to their natural unstressed positions shown in dot-dash lines in FIG. 3.

Turning now to FIGS. 1 and 3, seat 14 also includes a pair of fabric cover sections 24 and 26 which are slid onto frame 20 from the opposite ends of the frame. Each cover section is in the form of a generally rectangular bag or sheath that fits snugly over the corresponding end of frame 20. Moreover, on the frame 20, the cover section 24 overlaps cover section 26 at the junction of seat portions 14*a* and 14*b*. The cover sections may then be suitably releasably connected together to prevent slippage of the covers relative to the frame. For example, strips 28*a* and 28*b* of Velcro brand hook material and loop material may be attached to the inside of the upper rear edge margin of cover section 24 and the outside of the upper lower edge margin of cover section 26, respectively.

The bag-like cover sections 24 and 26 are more or less rectangular in shape as shown in FIG. 2 and their dimensions, particularly their lateral or side-to-side dimensions, are selected so that the cover sections are only slightly wider than pretensioned frame 20 to facilitate installation. Consequently, when the cover sections are engaged on the frame as shown in FIG. 1, the cover material is stretched between the upper and lower ends 20*a* and 20*b* of frame 20 as well as between the pretensioned frame side portions 20*c* and 20*d*. Since the cover sections 24 and 26 are more or less rectangular and contain no extra slack, they can be composed of straightsided rectangular pieces of fabric which are easy to cut and stitch together to form cover sections which correctly and snugly fit frame 20. While we have specifically illustrated the cover for frame 20 as being composed of two sections, a single long, open-ended, bag-like cover with a zippered closure could just as well be provided for that frame.

Referring again to FIGS. 1 and 2, the base 16 of seat 10 comprises a pair of spaced-apart, parallel, upstanding, mirror-image, support members 16*a* and 16*b*. The counterfacing surfaces of those support members are provided with grooves or slots 32 and 34 respectively which conform to a lengthwise segment or segments of seat 14 in edge profile. The base support members 16*a* and 16*b* may be solid pieces as shown herein and have grooves which are relatively long and continuous. Alternatively, each such member may be an open structure and constitute an assembly of more than one structural member as shown, for example, in my aforesaid pending application whose disclosure is incorporated by reference herein, in which case the grooves 32 and 34 may be discontinuous and shorter in length. In either event, the covered seat frame 14 is sandwiched between the support members 16*a* and 16*b* so that the sides 20*c* and 20*d* of the seat frame, or more particularly at least the lengthwise segments thereof opposite grooves 32 and 34, are snugly received in grooves 32 and 34. The base support members are maintained in proper spaced relation by a pair of front and rear spacer members 16*c* and 16*d* positioned between the front and rear margins of the support members, only the front spacer member 16*a* being shown in FIG. 1. The spacer members are positioned far enough below seat 14 so that they do not engage or obstruct the downward and rearward stretching of seat 14 that may occur when a person sits in the chair. The support members are releasably secured to the opposite ends of the spacer members by appropriate fasteners 38 so that the base constitutes a rigid stable box-like frame. It should be understood that the lengths of the spacer members 16*c* and 16*d* are such that, when the support members are fastened to the spacer members, the support members are drawn tightly toward one another so that the opposite sides of the seat 14 are engaged firmly in their supporting grooves 32 and 34. In other words, each spacer member has a length which is more or less equal to the width of seat 14 minus the combined depths of grooves 32 and 34.

In the illustrated chair 10, the fasteners 38 comprise bolts which extend through lateral holes 42 at the front and rear of each base support member 16*a* and 16*b*. Those holes are aligned with matching holes 44 in the corresponding ends of the spacer members 16*c* and 16*d*. Further, as shown in FIG. 2, a pair of openings 44*a* is formed into the inside surface of spacer member 16*d* to intersect with holes 44. Although not visible in FIG. 2, an identical pair of openings 44*a* is formed into the inside surface of spacer member 16*c*. A fastening nut 38*a* is inserted in each of the openings 44*a* and aligned with each hole 44. The support members 16*a* and 16*b* may thus be secured to the spacer members 16*c* and 16*d* by threading the bolts onto nuts 38*a* and tightening them. Alternatively, doweling or another appropriate fastening technique can be used to connect together the various members which form base 16.

When chair 10 is fully assembled as shown in FIG. 1, the pretensioned seat frame side portions 20*c* and 20*d* have a fixed spacing determined by loop 22 and are supported by the side members 16*a* and 16*b*. When a person sits in the chair, the inward forces exerted by the weighted cover sections 24 and 26 are offset by the outward bias of those prestressed side portions held at constant distance by loop 22. Only if the weight on the cover exceeds the bias will the seat frame side portions move inward. The outward bias is sufficiently large to exceed the weight of an ordinary medium to heavy person. Therefore, the frame normally rests securely in the supporting grooves 32 and 34 of the support members 16*a* and 16*b*.

Once the cover sections 24 and 26 have been installed on the frame, loop 22 can be severed and removed in some cases, if desired, since the pretensioned condition of frame 20 will be maintained by the frame cover sections 24 and 26. However, some fabrics have a tendency to stretch under tension which causes the spacing of the frame portions 20*c* and 20*d* to change with time and to vary from fabric to fabric. In such cases, frame loop 22 has the important function of holding frame portions 20*c* and 20*d* at a fixed and predictable spacing. Since the loop is made from flexible strapping, it is not felt by the person sitting in the chair.

It is also possible to utilize base 16 to balance the outward bias of frame portions 20*c* and 20*d*. However, this means exerting a considerable force on support members 16*a* and 16*b* which must be taken up by the spacer members 16*c* and 16*d*. Since the force results in bending moments around the bolted connections 38, 38*a*, that arrangement requires a much stronger base construction than is required otherwise.

It will thus be seen that the objects set forth above, among those made apparent from the preceding description, are efficiently attained. Also, certain changes may be made in the above construction without departing from the scope of the invention. For example, the specific shape of seat 14 and the specific design of the base members 16*a* to 16*d* may be varied to match any desired decor. Also, the base support members 16*a* and 16*b* may retain and support seat 14 by way of inwardly projecting brackets, pegs or ridges which engage above and below the side edge margins of the seat. Further, the base members 16*c* and 16*d* could be secured to the front and rear ends of members 16*a* and 16*b* instead of to the counterfacing surfaces thereof. Additionally, for added comfort, appropriate cushions (not shown) may be positioned on the seat portion 14*a* and back portion 14*b* of the chair as described in my aforesaid pending application. Therefore, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. An article of furniture of the type including a seat composed of a closed frame and a flexible cover covering said frame, a pair of spaced-apart, upright support members having frame retaining means formed therein conforming to the contour of one or more side portions of said frame in edge profile and a pair of spacer members connected between said support members under the front and rear of the seat so that said seat is suspended from said support members, the improvement wherein A. the sides of the frame are flexible and resilient and bowed away from one another with a natural spacing;

B. said seat includes means for prestressing said frame side members to a selected lesser spacing wherein they are in substantial parallelism as to stiffen the frame; and C. said retaining means engage said frame side portions at their said lesser spacing so that said frame side portions are supported securely by said support members when an ordinary person sits on the seat, yet exert substantially no lateral force on said support members.

2. The article of furniture defined in claim 1 wherein said maintaining means comprise an inextensible band connected between said frame sides whose length corresponds more or less to said lesser spacing.

3. The article of furniture defined in claim 1 wherein said cover comprises a pair of flexible bags A. having a width more or less equal to said lesser spacing; and B. covering opposite end portions of said frame.

4. The article of furniture defined in claim 3

A. wherein said pair of bags have respective lengths such that the ends of said bags overlap along an intermediate portion of said frame; and B. further including means for removably securing together the overlapped edges of said bags.

5. The article of furniture defined in claim 1 wherein said cover comprises

A. a single flexible open-ended bag having a width more or less equal to said lesser spacing; and B. means for releasably closing the open end of said bag.

6. The article of furniture defined in claim 1 wherein said frame comprises metal tubing.

7. The article of furniture defined in claim 6 wherein the said tubing includes

A. a pair of generally U-shaped frame members; and

B. means for interconnecting the free ends of said frame members, said connected-together frame members having a contour which, in edge profile, conforms to the anatomy of a person in a seated position.

8. The article of furniture defined in claim 1 wherein each of said support members comprises an open frame member.

9. The article of furniture defined in claim 1 wherein said maintaining means comprise an inextensible loop, A. engaged onto said frame from one end; and B. stretching between said frame sides.

10. The article of furniture defined in claim 9 wherein said one end of the frame is tapered to facilitate engaging said loop onto said frame.

* * * * *